United States Patent [19]

Niederer et al.

[11] 4,410,079

[45] Oct. 18, 1983

[54] EGG CONVEYOR TURNING APPARATUS

[75] Inventors: Lee H. Niederer, Titusville; Steven D. Niederer, Pennington, both of N.J.

[73] Assignee: Otto Niederer Sons, Inc., Pennington, N.J.

[21] Appl. No.: 322,817

[22] Filed: Nov. 19, 1981

[51] Int. Cl.[3] ..... B65G 47/26

[52] U.S. Cl. ..... 198/424; 198/432; 198/779

[58] Field of Search ..... 198/424, 432, 434, 779, 198/384, 387

[56] References Cited

U.S. PATENT DOCUMENTS

| | | | |
|---|---|---|---|
| 1,343,184 | 6/1920 | Baker et al. | 198/424 |
| 2,687,802 | 8/1954 | Davis . | |
| 2,704,146 | 3/1955 | Reck . | |
| 2,717,729 | 9/1955 | Page et al. . | |
| 2,919,787 | 1/1960 | Reck et al. . | |
| 3,010,578 | 11/1961 | Butterfield . | |
| 3,080,955 | 3/1963 | Fennell . | |
| 3,148,761 | 9/1964 | Niederer et al. | 198/384 |
| 3,428,162 | 2/1969 | Niederer . | |
| 3,610,400 | 10/1971 | Burkholder . | |
| 3,623,591 | 11/1971 | Koch et al. | 198/432 |
| 3,710,918 | 1/1973 | Babvnovic . | |
| 3,716,127 | 2/1973 | Loeffler . | |
| 4,042,100 | 8/1977 | Morrone . | |
| 4,117,922 | 10/1978 | Niederer | 198/779 |

*Primary Examiner*—Joseph E. Valenza
*Assistant Examiner*—Jonathan D. Holmes
*Attorney, Agent, or Firm*—Frederick A. Zoda; John J. Kane

[57] ABSTRACT

An apparatus is disclosed for turning a conveyor at a relatively sharp angle within a very narrow longitudinal path. The apparatus includes an egg delivery conveyor positioned above an egg receiving conveyor with apertures in the bottom of the delivery conveyor adapted to allow eggs to pass downward therethrough to be received and maintained in rows on the receiving conveyor. Each aperture may include a ramp member therebelow to guide movement of the egg onto the receiving conveyor. The preferred configuration of the delivery conveyor includes a plurality of primary springs arranged usually in groups of six about a rod which extends laterally across the delivery conveyor. The rod is driven and thereby provides the source of drive for the delivery conveyor. Each primary spring includes a secondary spring secured with respect to the rod for pivotal movement with respect thereto. The bracket connecting the primary and secondary springs includes a cam thereon which follows a track in the delivery conveyor. When the cam is in the steady state position within the delivery conveyor the secondary spring, in combination with the trailing primary spring will define an egg receiving recess therebetween. When the primary spring becomes positioned over an aperture the cam attached to the brackets pivotally secured thereto will drop downwardly and follow a cam surface which causes the secondary spring to move downwardly thereby widening the egg receiving area between the secondary spring and the trailing primary spring to thereby release the egg to allow it to pass through an aperture onto the receiving conveyor located therebelow.

14 Claims, 3 Drawing Figures

EGG CONVEYOR TURNING APPARATUS

BACKGROUND OF THE INVENTION

1. Field of the Invention

The present invention deals with the field of conveying eggs and in particular with the formation of conveyors useful for transporting eggs between locations for processing such as washing, candling, drying, weighing, sorting and arranging. The present invention provides a means for changing the direction of movement of a conveyor to minimize the amounts of space needed for a conveyor within a processing facility and thereby maximize the number of processing lines which might be used within a given facility.

2. Description of the Prior Art

Prior art devices for effecting such a turning of conveyors have normally required a variation in the lateral spacing of the rows during the turn. Alternatively, such configurations have used an increased speed of the eggs in the outer arc of the turn or a slower speed for the eggs on the internal arc of the turn. In either case, a substantially complicated construction was required. The present invention provides a means for turning an egg spring conveyor within a very short distance along the conveyance direction and allows turning of any angle. The present invention particularly is shown turning through a 90° angle, but any angle can be used. Also, the present invention is particularly shown with six input rows and six output rows but the number of input and output rows could be changed and need not be the same number. Also, the spacing between rows can be varied as desired by changing aperture spacing.

SUMMARY OF THE INVENTION

The present invention provides an egg conveyor turning apparatus which receives eggs upon an egg delivery conveyor means and transports them to an egg receiving conveyor means which is oriented angularly with respect to the delivery conveyor. The receiving conveyor includes a plurality of egg receiving means adapted to receive the eggs from the delivery conveyor. The delivery conveyor is preferably positioned extending above and immediately over the egg receiving conveyor.

The delivery conveyor includes preferably a plurality of rod means which extend laterally thereacross. These rod means are preferably secured to a chain means extending longitudinally along the delivery conveyor at the outermost end thereof. The chain means provides the source of drive for the delivery conveyor by the driving of the plurality of rod means. Each of the rod means itself is longitudinally movable by this drive means in a uniform direction along the direction of movement of the delivery conveyor. The rod means themselves extend laterally across the delivery conveyor.

A plurality of primary spool means or spring means are mounted upon the rod means and extend laterally across the delivery conveyor. In order to minimize breakage, flexible springs may be preferred over plastic or rubber support spools. Preferably each rod means includes six or perhaps twelve such primary spring means secured therearound. Each spring means has associated therewith a secondary bracket means which is pivotally secured with respect to the rod about which the primary spring means is secured. The bracket means generally extend in the trailing direction with respect to the direction of movement of the delivery conveyor and each bracket means includes a cam means thereon. A plurality of secondary spools or spring means are secured with respect to the bracket means. Each single primary spring means includes a single secondary bracket means associated therewith and a single secondary spring means secured with respect to said bracket means. The primary spool means and the secondary spool means of such a set may each be rotatable about the rod on which they are mounted. Also, they may be configured such as not to be rotatable. This is not an important aspect of the invention since both configurations are completely usable within the concept of the present design. For example, it would be entirely possible to form this unit of primary spool, secondary spool and bracket as a single formed integral unit out of a molded material such as rubber or plastic and still come within the purview of the concept of the present invention. Each secondary spring means is also pivotally secured with respect to the rod means and is positioned upstream from the primary spring means to which it is associated. The secondary spring means and the trailing one of the primary spring means are spatially disposed with respect to one another at a distance approximately less than the size of an egg to thereby define an egg holding means therebetween. In this manner with six such groupings of primary and secondary springs and bracket means associated with each rod means then six such holding means will be defined longitudinally across the delivery conveyor.

A track means is defined extending longitudinally along the egg delivery conveyor means at a location therebelow to thereby abut the cam means of the second bracket means and maintain the longitudinal dimension of the egg holding means. This track means basically extends horizontally to maintain the cam means of the bracket means in the steady state egg holding position.

Egg aperture means are defined in the delivery conveyor immediately below the path of movement of the egg holding means at locations immediately above the egg receiving means defined by the egg receiving conveyor. A camming surface is placed along the edge of the track means adjacent to each of the egg aperture means to thereby abut the cam traveling therealong and control movement thereof. The camming surface allows downward movement of the cam and thereby the resulting downward pivotal movement of the secondary spring means to thereby longitudinally widen the egg holding means to release an egg held therein such that it can pass downwardly through the egg aperture means onto the egg receiving conveyor located therebelow. Preferably the camming surface is of a resilient material such as a flat spring to allow downward movement of the cam means responsive to the downward pressure being exerted by the weight of the egg and the secondary spring. This downward movement will cause widening of the distance between the secondary spring means and the trailing primary spring means to release the egg through the aperture which is located adjacent to the camming surface. Preferably this flat spring is secured at one end only to the egg delivery conveyor to thereby increase the resilience and capability for downward flexing thereof to facilitate release of the eggs for passing through the apertures defined therein.

In order to insure the minimizing of breakage a ramp means is preferably positioned immediately below each of said aperture means. This ramp means may be of a variety of contours but preferably is a downwardly inclined ramp with perhaps a slight curve to give the egg a general impetus of movement in the direction of the movement of the conveyor located therebelow. In this manner the egg will gradually slide along the ramp downwardly and be gently discharged upon the moving conveyor located therebelow. This will prevent any dropping of the eggs from the aperture to the conveyor below.

To maintain good order of the eggs passing from the delivery conveyor to the receiving conveyor the six apertures are preferably oriented extending obliquely in a row at 45° with respect to the rows of the egg receiving means of the egg receiving conveyor means and also at 45° with respect to the rows of egg holding means of the egg delivery means. In other words the aperture located closest to the downstream direction of the egg receiving conveyor will be located along one horizontally extending egg row whereas the next one will be along the next horizontally extending egg row and thereby providing at 45° angle of oblique orientation of each of the apertures with respect to both the delivery and the receiving conveyor.

Preferably the second spring means is smaller than the primary spring means to facilitate vertical movement thereof and convenience in manufacture.

It is an object of the present invention to provide an egg conveyor turning apparatus capable of transfering the direction of conveyance of eggs through acute angles in very short conveyance distances.

It is an object of the present invention to provide an egg conveyor turning apparatus which is capable of controlled variation in spacing of the eggs from the delivery to the receiving conveyor.

It is an object of the present invention to provide an egg conveyor turning apparatus which can receive eggs with a given dimension between centers and discharge eggs with a different distance between centers.

It is an object of the present invention to provide an egg conveyor turning apparatus wherein the speed of eggs coming in can be increased or decreased with respect to the feed of the eggs on the exit conveyor.

It is an object of the present invention to provide an egg conveyor turning apparatus capable of receiving twelve rows of eggs and discharging the eggs in six rows.

It is an object of the present invention to provide an egg conveyor turning apparatus capable of changing the direction of movement of an egg conveyor through acute angles without changing spacing or varying the speed of movement of individual rows of the eggs.

It is an object of the present invention to provide an egg conveyor turning apparatus which is simple in design and easily maintained.

It is an object of the present invention to provide an egg conveyor turning apparatus which minimizes cost.

It is an object of the present invention to provide an egg conveyor turning apparatus which minimizes the time required for the movement of eggs in a direction perpendicular to the original conveyor.

It is an object of the present invention to provide a egg conveyor turning apparatus being particularly useful with spring conveyors.

It is an object of the present invention to provide an egg conveyor turning apparatus which transfers eggs from a delivery conveyor to a receiving conveyor therebelow and minimizes product damage.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
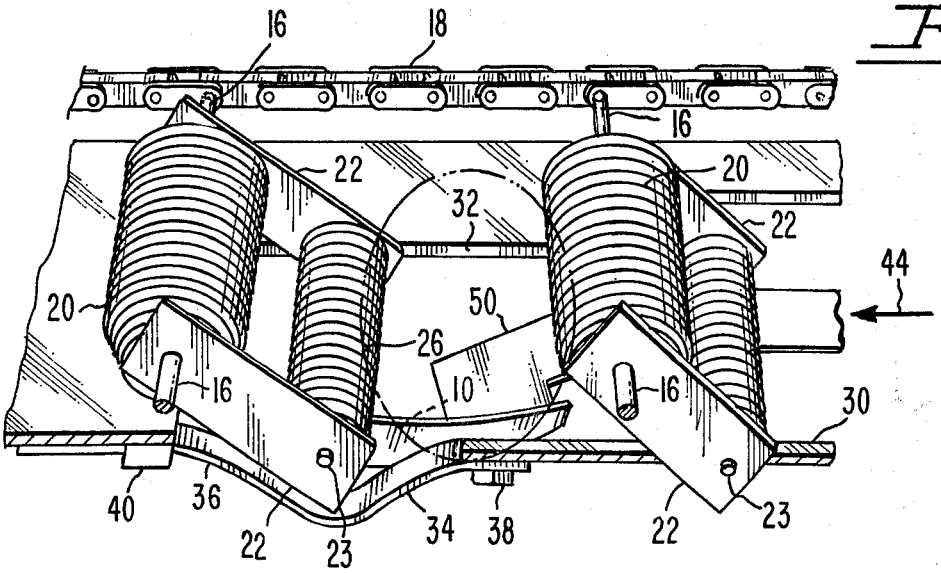
FIG. 1 is a perspective illustrative of an embodiment of an egg conveyor turning apparatus of the present invention.

The present invention provides a means for the movement of eggs 10 from an egg delivery conveyor 14 onto an egg receiving conveyor 12 wherein the receiving conveyor is oriented traveling in a direction obliquely angular with respect to the delivery conveyor 14. This invention is particularly useful with the more acute angles including a 90° angle but can be used with the input conveyor 14 at virtually any angle with respect to the output conveyor 12.

To accomplish this purpose a plurality of rod means 16 are included extending laterally across the direction of movement of the delivery conveyor 14. Each rod means is secured at one end thereof to a drive means 18 which preferably takes the form of a chain drive 18. This drive means provides the main force for movement of the egg delivery conveyor 14. The conveyor itself comprises basically the plurality of rod members 16 extending thereacross.

The egg delivery conveyor 14 may use any of a variety of egg support means such as primary spool means 20 and secondary spool means 26. These roller means may define a plurality of egg receiving recesses in rows.

Figure 3:
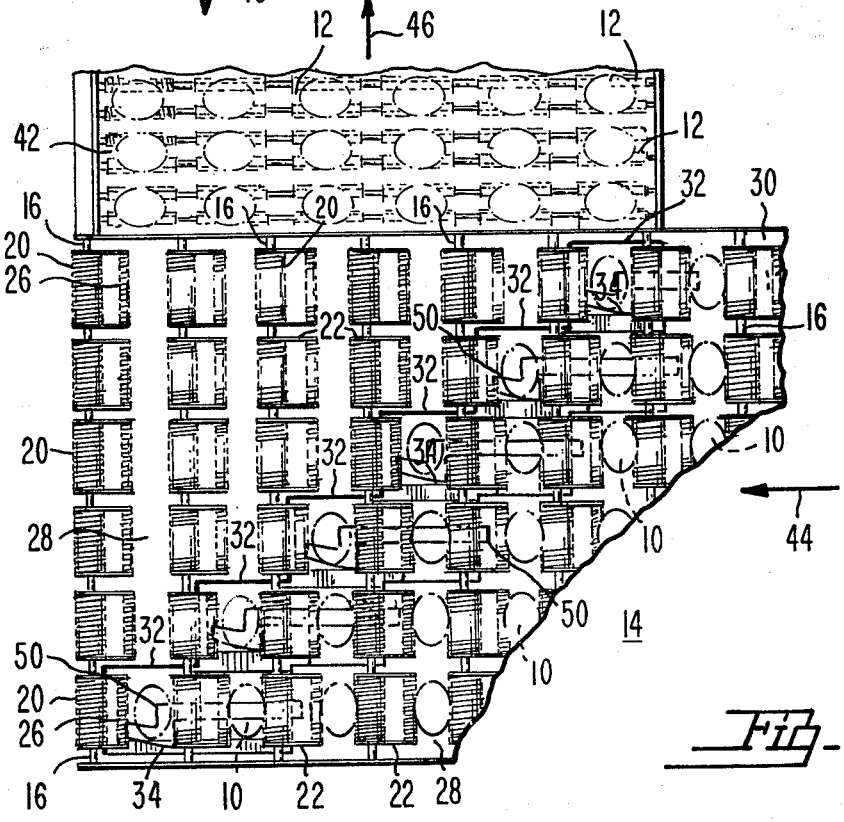
FIG. 3 is a top plan view of an embodiment of an egg conveyor turning apparatus of the present invention.

In the preferred configuration, the egg delivery conveyor 14 provides support to a plurality of eggs 10 in a resilient manner preventing breakage thereof by the formation of egg holding means 28 between specific spring means. In this configuration a plurality of primary spring roller means 20 are positioned extending about each rod means 16. As shown in FIG. 3, in a commonly used configuration, six such primary spring means 20 are secured about each rod means 16.

Each primary spring means 20 is associated with a secondary spring means 26. Secondary spring or spool means 26 is secured at a spaced relation with respect to the primary spring means 20 by way of a secondary bracket means 22. Bracket means 22 itself is specifically secured with respect to the rod means to be freely movable pivotally with respect thereto. In this manner the secondary spring means will also be pivotally movable with respect to rod means 16 as well as the primary spring means 20. To maintain engagement between the secondary bracket means 22 and the secondary spring means 26 a secondary rod means 23 may be included as a portion of the secondary bracket means 23 about which the secondary spring means 26 is mounted. With this configuration pivoting of the secondary bracket means 22 will cause vertical movement of the secondary spring means 26 to thereby vary the distance between the secondary spring means 26 and the trailing primary spring means 20 which is not secured with respect to that given secondary spring means 26.

The primary spool means 20 and the secondary spool means 26 in combination with a bracket means 22 forms a single unit of egg support equipment. This unit could be formed as a single integral unit of plastic or rubber material. It could be formed alternatively of a spring or spool configuration with or without the individual spools being capable of rotation. These are very specific embodiments which all come within the general concept of the present invention.

Each secondary spring means 26 is associated with the leading primary spring means 20 by being secured thereto by bracket means 22. On the other hand, each secondary spring means 26 is associated with the trailing primary spring means 20 not by being secured thereto but by cooperating therewith to define an egg holding means 28 therebetween. The distance between each secondary spring means 26 and the trailing primary spring means 20 is preferably chosen to be smaller than the diameter of most eggs encountered such that the egg holding means 28 is cooperatively created.

A track means 30 extends longitudinally with respect to the egg delivery conveyor 14. A cam means 24 is defined by the bracket means 22 in such a fashion that it travels in abutment with the track means 30. This is the steady state position wherein the distance between the secondary spring means 26 and the trailing primary spring means 20 is less than the dimension of a normal egg.

It is desirable to release an egg from the egg holding means 28 so as to move downwardly through egg aperture means 32 defined within the delivery conveyor 14. These individual apertures are placed at pre-designated locations immediately below the path of travel of each row of eggs 10 upon the delivery conveyor 14. At each aperture means 32 a camming surface 34 is interposed within the track means 30. This camming surface 34 allows the cam means 24 of the secondary bracket means 22 to move downwardly thereby increasing the longitudinal dimension of the egg holding means 28 and allowing release of an egg retained therein to pass downwardly through the egg aperture means 32 onto a ramp means 50 to be gently delivered on the egg receiving conveyor 12 located immediately therebelow. This downward movement of the cam means 24 results in downward rotation of the secondary bracket means 22 and resulting downward pivotal movement of the secondary spring means 26. In this manner the distance between each secondary spring means 26 will be increased from the trailing primary spring means 20 thereby increasing this longitudinal dimension of the egg holding means 28 and allowing for release of the egg through the aperture as above described.

Figure 2:
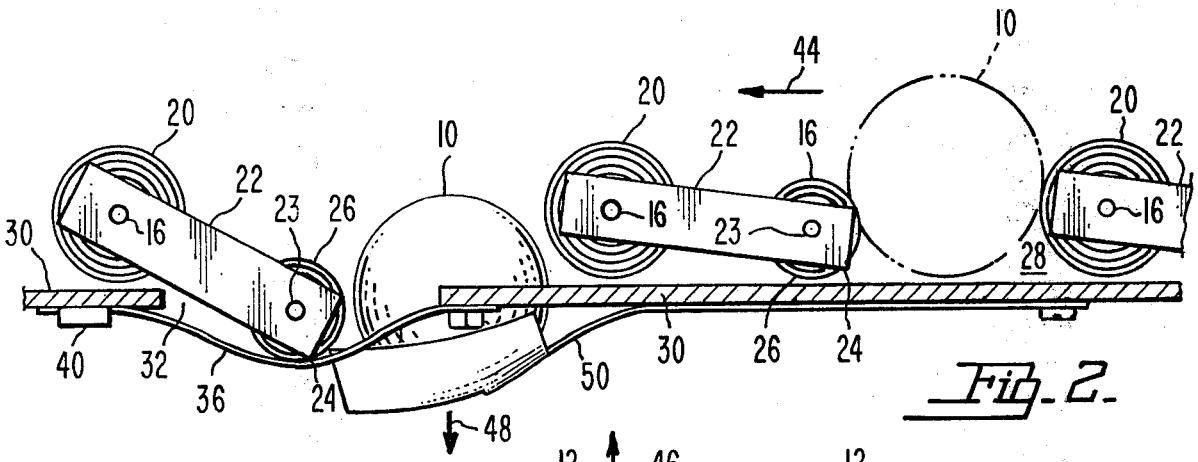
FIG. 2 is a side plan view of the embodiment illustrated in FIG. 1.

In order to carefully control the release of such eggs it is preferable to provide the camming surface 34 as a flat spring 36. The flat spring is preferably secured at one end to the track in a fixed manner by an attachment means such as a bolt 38. In the configuration shown in FIGS. 1 and 2, the other end of the flat spring 36 is in slideable engagement 40 with respect to the track means 38. Therefore, as the delivery conveyor 14 is traveling along when the cam means 24 contacts the flat spring 36 a downward pressure will be exerted thereon by the weight of the egg 10 itself causing downward flexing of the flat spring 36 and slight movement within the slide engagement 40 thereby increasing the longitudinal dimension of the egg holding means 28 and the releasing of the eggs 10 to transfer downwardly through the aperture 32 into the egg receiving means 42 defined within the egg receiving conveyor 12 located therebelow.

Each of the egg aperture means 32 is located immediately above the egg receiving conveyor 12. In order to control movement of eggs from the point of passage through the aperture means to the receiving conveyor 12 it is preferable to provide some type of guide means. One embodiment of such a guiding means is a ramp means 50 as disclosed in the present invention and is shown in the figures herein. This ramp means has a generally downward incline such that an egg after passing through the aperture means may be gradually and gently passed downward therealong to be softly deposited upon the egg receiving conveyor 12 located immediately below the ramp means. In this manner product breakage will be minimized.

The eggs are actually delivered as shown in FIG. 3 on the delivery conveyor in the direction of movement shown by arrow 44. The eggs are received by the receiving conveyor and moved in the direction of movement 46. Eggs move from the delivery conveyor 14 to the receiving conveyor 12 by movement downward as shown by arrow 48. Upon viewing the entire configuration of FIG. 3 it can be seen that the eggs travel along arrow 44 and are allowed to move downwardly at each successive one of the six apertures 32 shown such as to fill the egg receiving conveyor 12 and in fact fill each of the egg receiving means 42 defined therein. A tight angular turning is created without varying the lateral spacing of the eggs. However, it is often desirable to vary the spacing as desired. In this manner the lateral distance between rows can be increased or decreased by changing the angle of the apertures with respect to the input and output conveyors to other than a 45° angle. In a similar manner it is possible to have an input of 6 with an output of 6 or an input of 12 with an output of 6 by varying the speed of the input and output conveyor with respect to one another. It is also possible to have an equal input and output other than 6 since some systems are designed for usage with two, three, five six, ten or twelve rows. Any of these possibilities can be achieved as well as any spacing can be achieved with the present invention by varying of the angle or spacing of the apertures in the turning apparatus. In the configuration shown in FIG. 3 each successive aperture is at one row downstream from the previous aperture such that an exact 45° angular placement is achieved. With this design we have six rows flowing into six rows which is one of the most conventional configurations.

While particular embodiments of this invention have been shown in the drawings and described above, it will be apparent that many changes may be made in the form, arrangement, and positioning of the various elements of the combination. In consideration thereof it should be understood that preferred embodiments of this invention disclosed herein are intended to be illustrative only and not intended to limit the scope of the invention.

We claim:

1. An egg conveyor turning apparatus comprising:

(a) an egg receiving conveyor means including egg receiving means therein;

(b) an egg delivery conveyor means positioned extending above and immediately over said egg receiving conveyor means and oriented angularly with respect thereto, said egg delivery conveyor means comprising:

1. a plurality of rod means extending laterally across said egg delivery conveyor means, said rod means being longitudinally movable with respect to said egg delivery conveyor means for transporting eggs therealong;
2. a plurality of primary spool means mounted upon said rod means and extending laterally across said egg delivery conveyor means;
3. a secondary bracket means pivotally secured with respect to said rod means adjacent each one of said primary spool means and extending in the trailing direction therefrom with respect to the direction of movement of said egg delivery conveyor means, said secondary bracket means including a cam means thereon;
4. a plurality of secondary spool means secured with respect to each of said secondary bracket means to be pivotally secured with respect to said rod means and with respect to the one of said primary spool means thereadjacent in the leading direction, said secondary spool means and the trailing one of said primary spool means being spatially disposed with respect to one another at less than the size of an egg to define an egg holding means therebetween;

(c) a track means extending longitudinally with respect to said egg delivery conveyor means at a location therebelow to abut said cam means of said second bracket means and maintain the longitudinal dimension of said egg holding means;

(d) an egg aperture means below said egg conveyor means and immediately below the path of movement of said egg holding means at a location above said egg receiving means of said egg receiving conveyor; and (e) a camming surface interposed along said track means adjacent to each of said egg aperture means to abut said camming traveling therealong and allow downward movement of said cam means and downward pivotal movement of said secondary roller means to longitudinally widen said egg holding means to release an egg held therein to pass downwardly through said egg aperture means onto said egg receiving conveyor therebelow.

2. The apparatus as defined in claim 1 wherein said camming surface is resilient to allow downward movement of said cam means responsive to downward pressure of the weight of an egg retained within said egg holding means.

3. The apparatus as defined in claim 2 wherein said resilient camming surface comprises a flat spring fixedly secured to said track means only at one end to allow downward flexing thereof.

4. The apparatus as defined in claim 1 wherein six of said primary spool means are secured laterally along each of said rod means to define six longitudinally extending rows of egg holding means on said egg delivery conveyor means.

5. The apparatus as defined in claim 4 wherein an aperture means is located below each of said six rows.

6. The apparatus as defined in claim 4 wherein said six aperture means are oriented in an obliquely extending row at 45° with respect to the rows of said egg receiving means of said egg receiving conveyor means and at 45° with respect to the rows of said egg holding means of said egg delivery conveyor means.

7. The apparatus as defined in claim 1 wherein twelve of said primary spool means are secured laterally along each of said rod means to define twelve longitudinally extending rows of egg holding means on said egg delivery conveyor means.

8. The apparatus as defined in claim 1 wherein said secondary spool means are similar than said primary spool means.

9. The apparatus as defined in claim 1 further including a chain drive means extending longitudinally along said egg delivery conveyor means and secured to each of said rod means for driving thereof.

10. The egg conveyor turning apparatus as defined in claim 1 wherein said primary spool means comprise secondary spring means.

11. The egg conveyor turning apparatus as defined in claim 1 wherein said secondary spool means comprise secondary spring means.

12. The egg conveyor turning apparatus as defined in claim 1 wherein each of said primary spool means and secondary bracket means and secondary spool means form a single integral member.

13. The egg conveyor turning apparatus as defined in claim 1 further including a plurality of ramp means located beneath each of said egg aperture means to guide eggs through said egg aperture means on to said egg receiving conveyor means located therebelow.

14. An egg conveyor turning apparatus comprising:

(a) an egg receiving conveyor means including egg receiving means therein;

(b) an egg delivery conveyor means positioned extending above and immediately over said egg receiving conveyor means and oriented angularly with respect thereto, said egg delivery conveyor means comprising:

1. a plurality of rod means extending laterally across said egg delivery conveyor means, said rod means being longitudinally movable with respect to said egg delivery conveyor means for transporting eggs therealong;
2. a plurality of primary spring means mounted in groups of six upon said rod means and extending laterally across said egg delivery conveyor means;
3. a secondary bracket means pivotally secured with respect to said rod means adjacent each one of said primary spring means and extending in the trailing direction therefrom with respect to the direction of movement of said egg delivery conveyor means, said secondary bracket means including a cam means thereon;
4. a plurality of secondary spring means secured with respect to each of said secondary bracket means to be pivotally secured with respect to said rod means and with respect to said one of said primary spring means thereadjacent in the leading direction, said secondary spring means being smaller in diameter than said primary spring means, said secondary spring means and the trailing edge of said primary spring means being spatially disposed with respect to one another at less than the size of an egg to define an egg holding means therebetween in lateral rows of six extending across said egg delivery conveyor means;

(c) a track means extending longitudinally with respect to said egg delivery conveyor means at a location therebelow to abut said cam means of said second bracket means and maintain the longitudinal dimension of said egg holding means;

(d) an egg aperture means below each of said six rows of egg holding means of said egg conveyor means and immediately below the path of movement of said egg holding means at a location above egg receiving means of said egg receiving conveyor, said six aperture means being oriented in an obliquely extending row at 45° with respect to the rows of said egg receiving means of said egg receiving conveyor means and at 45° with respect to the rows of said egg holding means of said egg delivery conveyor means;

(e) a ramp means located below each of said egg aperture means to guide the movement of eggs there through on to said egg receving conveyor means located therebelow;

(f) a camming surface comprising a resilient flat spring interposed along said track means adjacent to each of said egg aperture means to abut said cam means traveling therealong and allow downward movement of said cam means and downward pivotal movement of said secondary spring means to longitudinally widen said egg holding means to release an egg held therein to pass downwardly through said egg aperture means onto said egg receiving conveyor therebelow; and (g) a chain drive means extending longitudinally along said egg delivery conveyor means and secured to each of said rod means for driving thereof.

* * * * *